US006155891A

United States Patent [19]

Daoud

[11] Patent Number: 6,155,891

[45] Date of Patent: Dec. 5, 2000

[54] PRE-WIRING GEL SEALING

[75] Inventor: Bassel H. Daoud, Parsippany, N.J.

[73] Assignee: Lucent Technologies, Inc., Murray Hills, N.J.

[21] Appl. No.: 09/124,582

[22] Filed: Jul. 29, 1998

[51] Int. Cl.[7] ..... H01R 9/24

[52] U.S. Cl. ..... 439/888; 439/936

[58] Field of Search ..... 439/709, 801, 439/888, 936

[56] References Cited

U.S. PATENT DOCUMENTS 4,734,061 3/1988 Randall, Jr. et al. ..... 439/709

4,824,390 4/1989 Crane et al. ..... 439/271

*Primary Examiner*—Khiem Nguyen

*Attorney, Agent, or Firm*—Baker & McKenzie

[57] ABSTRACT

A method of making wiring connections which are protected against environmental conditions. A wire wrap terminal is first coated with a thin film of silicone gel. After the silicone gel has cured, a wire is wrapped around the terminal. The wire displaces the silicone gel as it is wrapped around the terminal. Silicone gel trapped between the terminal and the windings of the wire prevents environmental elements from getting to and degrading the electrical contact interface between the wire and the terminal.

9 Claims, 3 Drawing Sheets

PRE-WIRING GEL SEALING

FIELD OF THE INVENTION

The present invention relates to a wiring connection process, in particular to a wiring connection process which protects the wiring against environmental conditions.

BACKGROUND INFORMATION

In conventional building entrance protectors (BEPs), a large number of IDC connector sockets are typically mounted thereon, with each socket having a wire-wrap tail protruding from the backside of the protector panel. Such a BEP 10 is shown in FIGS. 1A, 1B and 1C. The IDC socket terminals 20, however, and in particular the wire-wrap tails 25 of the socket terminals 20 are vulnerable to environmental conditions. As shown in FIG. 1C, bare wire is typically wrapped around the bare wire-wrap tails 25 of the BEP 10. In outdoor applications, in order to protect the wire-wrap tails 25 from the environmental elements, the backsides of the protector panels are typically completely potted. Unfortunately, the potting material can take a substantial amount of time to cure. Moreover, the cost of the potting material can be significant as a large volume of potting material may be required in order to fully cover the many wire-wrap tails. Furthermore, the potting process is necessarily performed after the BEP has been completely wired. This increases the amount of time that must be spent in the field and also hampers the ability to modify the wiring of the BEP once the potting material has been applied.

As such, there is a need for an environmental protection process which is low in cost, does not require a long processing time and which simplifies the wiring process in the field.

SUMMARY OF THE INVENTION

The present invention is directed to a wiring connection process which provides environmental protection in a fast and cost-effective manner and which simplifies and speeds the wiring process.

In accordance with the present invention, wire-wrap tails are sprayed with a thin film of silicone gel prior to the wiring process. After the gel has cured, the wire is wrapped around each wire-wrap tail, displacing the gel and allowing electrical contact between the tail and the wire. The gel trapped between the tail and the wrapped wire prevents the environmental elements from degrading the electrical connection and prevents rust from developing at the electrical contact point.

A thin film of silicone gel can also be applied to the IDC terminals to protect those electrical connections as well.

DETAILED DESCRIPTION

Figure 1A:
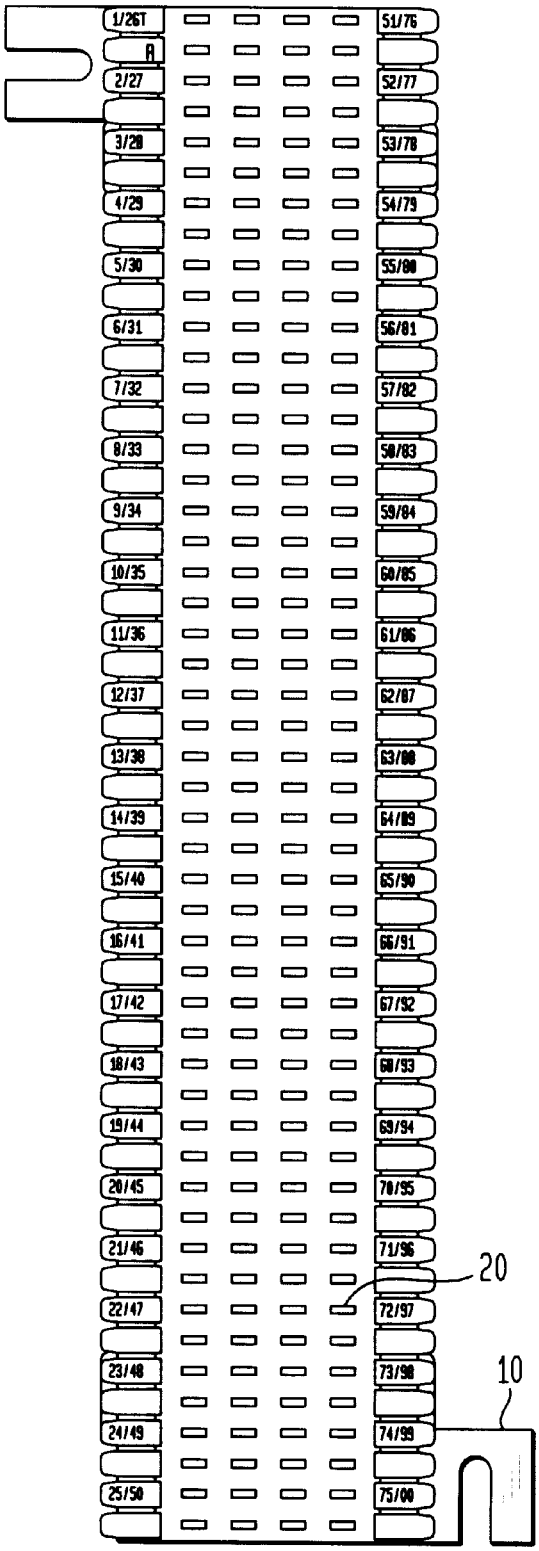
FIG. 1A (PRIOR ART)
FIG. 1A is a top view of a conventional building entrance protector (BEP).
Figure 1B:
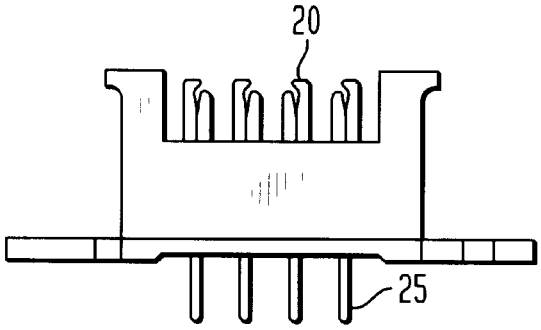
FIG. 1B (PRIOR ART)
FIG. 1B is a side view of the BEP of FIG. 1A.
Figure 1C:
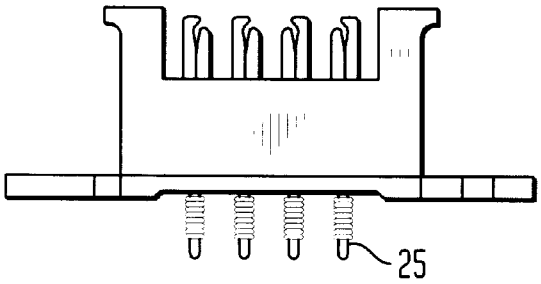
FIG. 1C (PRIOR ART)
FIG. 1C is a side view of the BEP of FIG. 1A with wire wrapped around the wire tails.
Figure 2A:
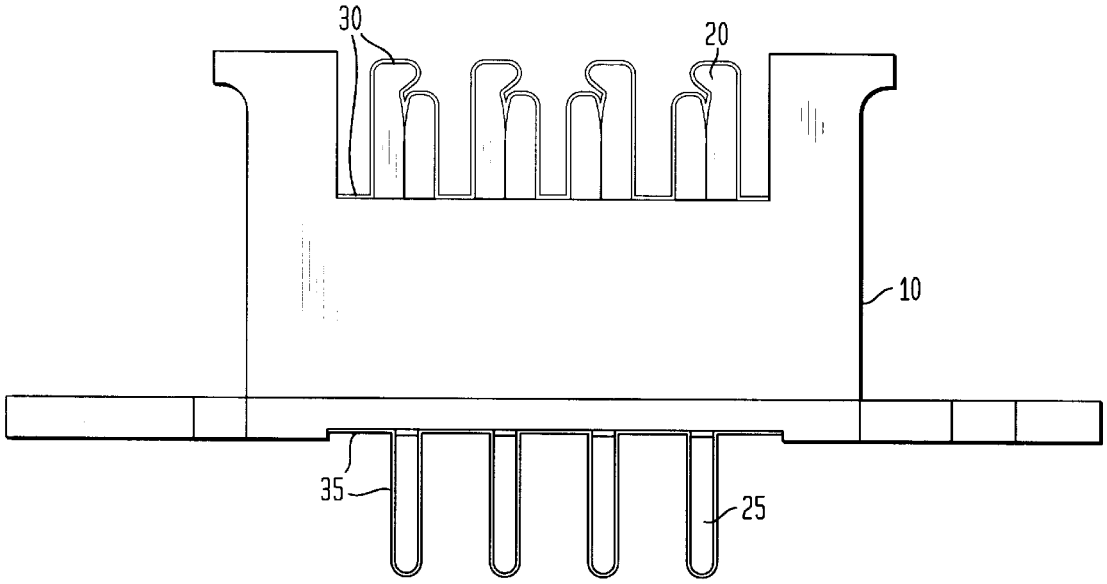
FIG. 2A is a side view of a BEP in accordance with the present invention.

The present invention provides a method of wiring in which the wiring connection is protected against environmental conditions. In one exemplary embodiment, the method of the present invention is applied to a conventional building entrance protector (BEP) 10, as shown in FIG. 2A. The BEP 10 includes a plurality of IDC socket connectors 20. Each IDC connector 20 has a wire-wrap tail 25 which protrudes from the backside (or bottom) of the BEP 10.

In accordance with the present invention, prior to wiring, a protective material such as a silicone gel is applied to the bottom side of the BEP 10 so as to cover each of the wire wrap tails 25. The silicone gel can be applied by spraying in a liquid state. As shown in FIG. 2A, the silcone gel is deposited in a thin film 35 on the wire wrap tails and on the bottom surface of the BEP 10. The thickness of the silicone gel film 35 on the wire wrap tails 25 should preferably be approximately half the diameter of the wire that is to be wrapped around the tails. Furthermore, the bottom surface of the BEP, which is typically made of plastic, should preferably have a coarse finish for better adhesion of the silicone gel. For example, the bottom surface of the BEP 10 can be molded with grooves or such features, or it can be etched or sanded accordingly.

As shown in FIG. 2A, a thin film 30 of silicone gel can also be applied onto the top side of the BEP 10 so as to cover the IDC terminals 20 and part of the top surface of the BEP. As with the bottom surface, the top surface of the BEP should have a coarse finish to enhance adhesion of the silicone gel.

Once the silicone gel films 30 and 35 have cured, the IDC sockets 20 and wire wrap tails 25 can be wired. The steps of applying the silicone gel and of allowing the silicone gel to cure can be carried out at any time prior to the wiring of the BEP 10, for example, in the manufacturing phase of the BEP. This simplifies the process of wiring the BEP 10 in the field and thus reduces the time spent in the field by service personnel.

Figure 2B:
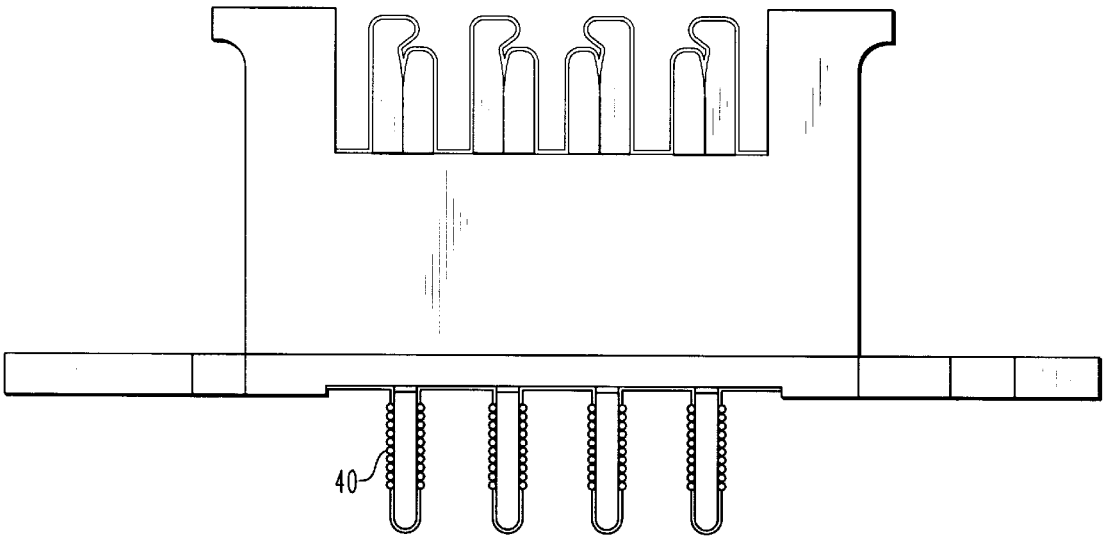
FIG. 2B is a side view of a BEP with wire wrapped around the wire tails in accordance with the present invention.
Figure 3:
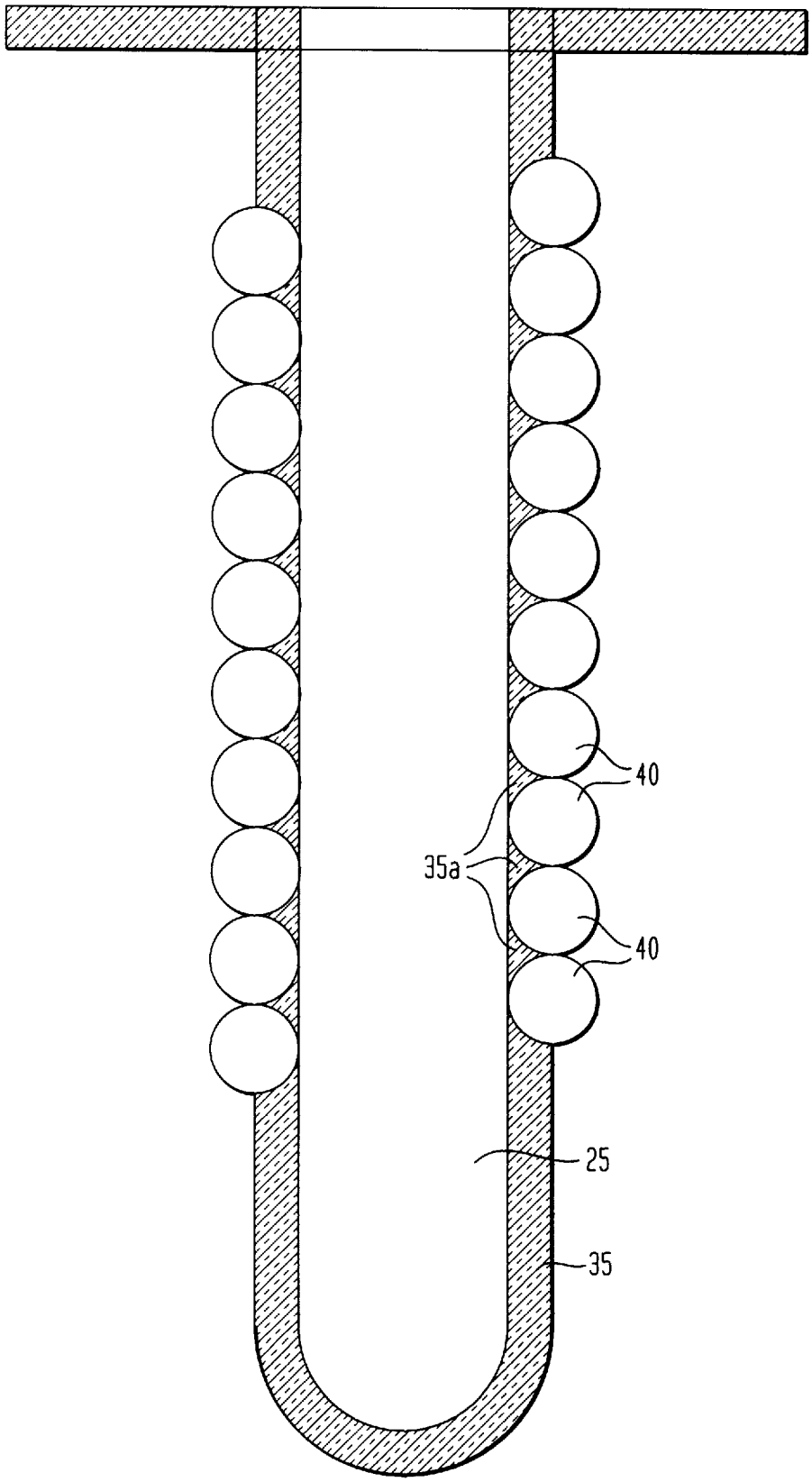
FIG. 3 is an enlarged view of a wire-wrap tail with wire wrapped thereon in accordance with the present invention.

FIG. 2B shows a side view of the BEP 10 with wire 40 wrapped around the wire wrap tails 25 which were coated with the silicone gel film 35. FIG. 3 shows an expanded view of a wire wrap tail 25 that has been coated with the silicone gel film 35 and wrapped with a wire 40. As the wire 40 is wrapped around the tail 25, the wire displaces the silicone gel. As shown in FIG. 3, the silicone gel 35*a* trapped between adjacent windings of the wire 40 and the tail 25, prevents environmental elements from getting to the contact interface between the tail 25 and the wire 40. As such, the development of rust at the contact interface is prevented and degradation of the electrical contact is thus avoided.

Similar protection is also afforded by coating the IDC connections 20 with a thin film 30 of silicone gel. In this case, the wire is pushed into the IDC terminal 20 after the silicone gel film 30 has cured.

What is claimed is:

1. A method of connecting a wire to a terminal comprising:

coating the terminal with a protective material, the terminal being a wire-wrap terminal;

curing the protective material; and applying the wire to the terminal by wrapping the wire around the terminal, wherein the wire displaces the protective material so that an electrical contact is made between the wire and the terminal and wherein the protective material covers the electrical contact, thereby protecting the electrical contact from environmental conditions.

2. The method of claim 1, wherein the protective material includes a silicone gel.

3. The method of claim 1, wherein the terminal is an IDC terminal and the wire is applied to the terminal by pushing the wire into the terminal.

4. The method of claim 1, wherein the protective material forms a protective film having a thickness substantially half of a diameter of the wire.

5. An electrical wiring device comprising:

a terminal adapted for an electrical connection to a wire, the electrical connection between the wire and the terminal is made by wrapping the wire around the terminal;

a surface of the terminal is coated with a film of protective material, the film of protective material being located between at least the terminal and the wire wrapped around the terminal; and a body, wherein the body holds the terminal.

6. The device of claim 5, wherein a portion of the body is coated with the protective material.

7. The device of claim 5, wherein the protective material includes a silicone gel.

8. The device of claim 5, wherein the terminal is an IDC terminal and connection between the wire and the terminal is made by pushing the wire into the terminal.

9. The device of claim 5, wherein the film of protective material has a thickness which is approximately half a diameter of the wire.

* * * * *